US010294074B2

(12) United States Patent
Olthuis et al.

(10) Patent No.: US 10,294,074 B2
(45) Date of Patent: May 21, 2019

(54) ELEVATOR RECOVERY CAR

(71) Applicant: OTIS ELEVATOR COMPANY, Farmington, CT (US)

(72) Inventors: Mark Olthuis, Avon, CT (US); Xiaodong Luo, South Windsor, CT (US); Zbigniew Piech, Cheshire, CT (US); Randall Roberts, Hebron, CT (US); Tadeusz Pawel Witczak, Bethel, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 35 days.

(21) Appl. No.: 15/225,325

(22) Filed: Aug. 1, 2016

(65) Prior Publication Data

US 2017/0029245 A1 Feb. 2, 2017

Related U.S. Application Data

(60) Provisional application No. 62/199,543, filed on Jul. 31, 2015.

(51) Int. Cl.

| | |
|---|---|
| ***B66B 5/00*** | (2006.01) |
| ***B66B 5/02*** | (2006.01) |
| ***B66B 11/04*** | (2006.01) |

(52) U.S. Cl.

CPC ..... *B66B 5/0087* (2013.01); *B66B 5/027* (2013.01); *B66B 11/0407* (2013.01)

(58) Field of Classification Search

CPC ..... B66B 5/0087; B66B 5/027; B66B 9/003; B66B 11/024; B66B 11/0246

See application file for complete search history.

(56) References Cited

U.S. PATENT DOCUMENTS

| | | | | |
|---|---|---|---|---|
| 627,257 | A * | 6/1899 | Haines et al. | B66B 5/027 182/95 |
| 837,826 | A * | 12/1906 | Handlan | B66B 5/027 182/90 |
| 4,511,017 | A | 4/1985 | MacDonald | |
| 5,288,956 | A * | 2/1994 | Kadokura | B66B 11/0407 187/250 |
| 5,445,245 | A * | 8/1995 | Ketoviita | B66B 5/0006 187/247 |
| 5,816,368 | A | 10/1998 | Barrett et al. | |
| 6,196,355 | B1 * | 3/2001 | Fargo | B66B 5/027 187/287 |
| 6,202,801 | B1 * | 3/2001 | Muller | B66B 11/0246 187/269 |

(Continued)

FOREIGN PATENT DOCUMENTS

| | | |
|---|---|---|
| EP | 0499254 A1 | 8/1992 |
| EP | 3586190 A1 | 3/1994 |

(Continued)

OTHER PUBLICATIONS

JPH05201642 English Translation.*

(Continued)

*Primary Examiner* — Minh Truong
(74) *Attorney, Agent, or Firm* — Cantor Colburn LLP

(57) ABSTRACT

A method and system for managing an elevator system, includes providing a recovery car to travel in the hoistway via a motor, and engaging the car via an attachment device of the recovery car.

19 Claims, 5 Drawing Sheets

(56) References Cited

U.S. PATENT DOCUMENTS

| | | | | |
|---|---|---|---|---|
| 6,364,066 | B1 * | 4/2002 | Bolch | B66B 5/0018 187/391 |
| 6,880,678 | B1 * | 4/2005 | Schneider | B66B 11/0246 187/314 |
| 6,955,245 | B2 * | 10/2005 | Dunser | B66B 1/2466 187/249 |
| 7,650,966 | B2 | 1/2010 | Sansevero et al. | |
| 8,307,952 | B2 | 11/2012 | Fargo et al. | |
| 8,430,210 | B2 | 4/2013 | Jacobs | |
| 2005/0224299 | A1 * | 10/2005 | Soemardjan | B66B 11/0246 187/406 |
| 2008/0149426 | A1 | 6/2008 | Kocher | |
| 2012/0006626 | A1 | 1/2012 | Adifon | |

FOREIGN PATENT DOCUMENTS

| | | | | |
|---|---|---|---|---|
| EP | 1647513 | A2 | 4/2006 | |
| EP | 2003081 | B1 | 1/2012 | |
| EP | 1982944 | B1 | 4/2014 | |
| JP | 03102085 | A * | 4/1991 | |
| JP | 05201642 | A * | 8/1993 | |
| JP | H06263361 | A | 9/1994 | |
| JP | 2001171932 | A | 6/2001 | |
| WO | WO-2013055346 | A1 * | 4/2013 | B66B 1/3461 |
| WO | 2013076866 | A1 | 5/2013 | |
| WO | 2014158127 | A1 | 10/2014 | |

OTHER PUBLICATIONS

JPH03102085 English Translation.*
EP Communication; Extended European Search Report; Application No. 16182264.8-1705; dated Jan. 4, 2017; pp. 1-9.

* cited by examiner

ELEVATOR RECOVERY CAR

CROSS REFERENCE TO RELATED APPLICATIONS

The present application claims priority to U.S. Provisional Patent Application Ser. No. 62/199,543 filed on Jul. 31, 2015, titled "ELEVATOR RECOVERY CAR," assigned to the assignee hereof which is incorporated herein by reference in its entirety.

DESCRIPTION OF RELATED ART

The subject matter disclosed herein relates generally to the field of elevators, and more particularly to a multicar, ropeless elevator system.

Ropeless elevator systems, also referred to as self-propelled elevator systems, are useful in certain applications (e.g., high rise buildings) where the mass of the ropes for a roped system is prohibitive, roped elevator core space can become too large, and there is a desire for multiple elevator cars to travel in a single lane. There exist ropeless elevator systems with multiple lanes in which some lanes are designated for upward traveling elevator cars and some lanes are designated for downward traveling elevator cars. Transfer stations at various locations in the hoistway are used to move cars horizontally between these various upward and downward moving lanes.

Over the course of operation of the elevator system, cars may become immobilized due to operating conditions or component malfunctions. During such events, occupants may remain within the immobilized cars. A system and method that can recover occupants and immobilized cars is desired to optimize occupant safety and elevator system performance.

BRIEF SUMMARY

According to an embodiment, a recovery car to recover a car in a hoistway of an elevator system, the recovery car includes a motor to transport the recovery car within the hoistway, and an attachment device to engage the car in the hoistway.

In addition to one or more of the features described above, or as an alternative, further embodiments could include a buffer to contact the car.

In addition to one or more of the features described above, or as an alternative, further embodiments could include a communication device to communicate with the car.

In addition to one or more of the features described above, or as an alternative, further embodiments could include a hatch to remove at least one occupant of the car.

In addition to one or more of the features described above, or as an alternative, further embodiments could include a ladder to provide access to the car.

In addition to one or more of the features described above, or as an alternative, further embodiments could include a shroud to retain the at least one occupant between the car and the recovery car.

In addition to one or more of the features described above, or as an alternative, further embodiments could include that the recovery car tows the car via the attachment device.

In addition to one or more of the features described above, or as an alternative, further embodiments could include that the recovery car is disposed above or below the car.

In addition to one or more of the features described above, or as an alternative, further embodiments could include a recovery car controller to disengage a brake of the car.

In addition to one or more of the features described above, or as an alternative, further embodiments could include that the recovery car controller tests a motor capability of the motor of the car.

According to an embodiment, a method to recover a car in a hoistway of an elevator system includes providing a recovery car to travel in the hoistway via a motor, and engaging the car via an attachment device of the recovery car.

In addition to one or more of the features described above, or as an alternative, further embodiments could include contacting the car with the recovery car via a buffer of the recovery car.

In addition to one or more of the features described above, or as an alternative, further embodiments could include communicating with the car via a communication device of the recovery car.

In addition to one or more of the features described above, or as an alternative, further embodiments could include removing at least one occupant of the car via a hatch of the recovery car.

In addition to one or more of the features described above, or as an alternative, further embodiments could include providing a ladder to the at least one occupant of the car.

In addition to one or more of the features described above, or as an alternative, further embodiments could include retaining the at least one occupant between the car and the recovery car via a shroud.

In addition to one or more of the features described above, or as an alternative, further embodiments could include providing at least one replacement component for the car via the recovery car.

In addition to one or more of the features described above, or as an alternative, further embodiments could include towing the car via the recovery car.

In addition to one or more of the features described above, or as an alternative, further embodiments could include disengaging a brake of the car via a recovery car controller.

In addition to one or more of the features described above, or as an alternative, further embodiments could include testing a motor capability of the motor of the car via the recovery car controller.

Technical function of the embodiments described above includes that the recovery car includes a motor to transport the recovery car within the hoistway, and an attachment device to engage the car in the hoistway Other aspects, features, and techniques of the embodiments will become more apparent from the following description taken in conjunction with the drawings.

BRIEF DESCRIPTION OF THE SEVERAL VIEWS OF THE DRAWINGS

The subject matter is particularly pointed out and distinctly claimed in the claims at the conclusion of the specification. The foregoing and other features, and advantages of the embodiments are apparent from the following detailed description taken in conjunction with the accompanying drawings in which like elements are numbered alike in the several FIGURES:

DETAILED DESCRIPTION

Figure 1:
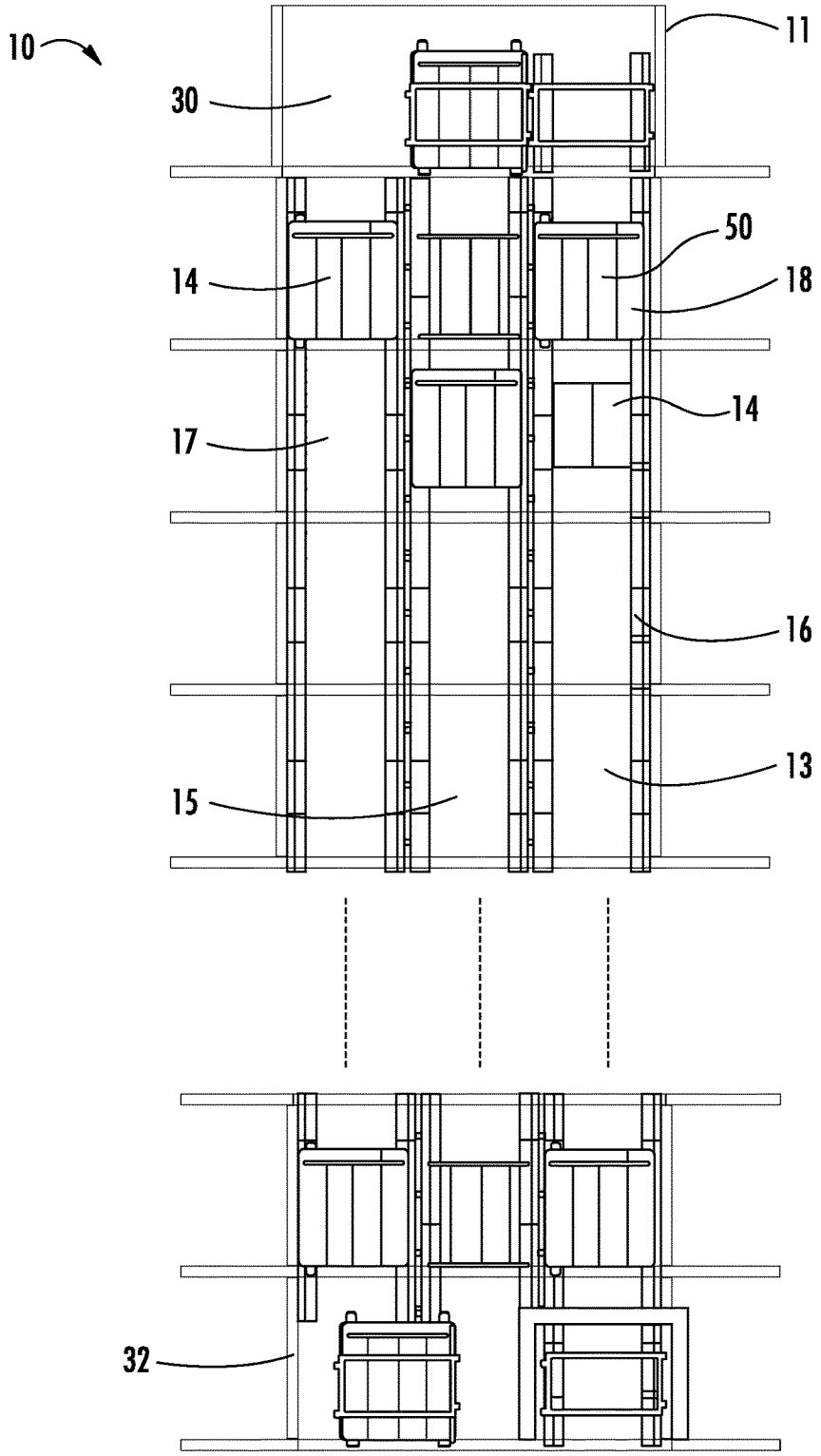
FIG. 1 depicts a multicar elevator system in an illustrated embodiment.

FIG. 1 depicts a multicar, ropeless elevator system 10 in an illustrated embodiment. Elevator system 10 includes a hoistway 11 having a plurality of lanes 13, 15 and 17. In certain embodiments, elevator system 10 includes modular components that can be associated to form an elevator system. Modular components include, but are not limited to a landing floor hoistway, a shuttle floor hoistway, a transfer station, a carriage, a parking area, a disengaging mechanism, etc. While three lanes are shown in FIG. 1, it is understood that embodiments may be used with multicar, ropeless elevator systems have any number of lanes. In each lane 13, 15, 17, cars 14 travel in mostly in one direction, i.e., up or down. For example, in FIG. 1 cars 14 in lanes 13 and 17 travel up and cars 14 in lane 15 travel down. One or more cars 14 may travel in a single lane 13, 15, and 17. In certain embodiments, cars 14 can move bi-directionally within lanes 13, 15, 17. In certain embodiments, lanes 13, 15, 17 can support shuttle functionality during certain times of the day, such as peak hours, allowing unidirectional, selective stopping, or switchable directionality as required. In certain embodiments, lanes 13, 15, 17 can include localized directionality, wherein certain areas of lanes 13, 15, 17 and hoistway 11 are assigned to various functions and building portions. In certain embodiments, cars 14 can circulate in a limited area of hoistway 11. In certain embodiments, cars 14 can operate at a reduced velocity to reduce operating and equipment costs. In other embodiments, hoistways 11 and lanes 13, 15, 17 can operate in a mixed mode operation wherein portions of hoistway 11 and lanes 13, 15, 17 operate normally (unidirectional or bidirectional) and other portions operate in another manner, including but not limited to, unidirectional, bidirectional, or in a parking mode. In certain embodiments, parked cars 14*a* can be parked in lanes 13, 15, 17 when lanes are designated for parking.

An upper transfer station 30 to impart horizontal motion to elevator cars 14 to move elevator cars 14 between lanes 13, 15 and 17. In an illustrated embodiment, upper transfer station 30 and lower transfer station 32 in addition to other transfer stations can be disposed at any suitable location. It is understood that upper transfer station 30 may be located at the top floor, rather than above the top floor. Below the first floor is a lower transfer station 32 to impart horizontal motion to elevator cars 14 to move elevator cars 14 between lanes 13, 15 and 17. It is understood that lower transfer station 32 may be located at the first floor, rather than below the first floor. Cars 14 are propelled using, for example, a linear motor system having a primary, fixed portion 16 and a secondary, moving portion 18. One or more fixed portions 16 are mounted in lanes 13, 15 and 17. One or more moving portions 18 are mounted on cars 14. One of the motor portions is supplied with drive signals to control movement of cars 14 in their respective lanes. In certain embodiments, lanes of hoistway 11 can be shut down or restricted based on operator input or elevator system conditions.

In the illustrated embodiment, the elevator system 10 can include at least one recovery car 50. The recovery car 50 can be utilized to rescue or recover occupants from within immobilized cars 14. During the course of operation, the cars 14 may experience mechanical malfunctions, electrical malfunctions, environmental conditions, or other conditions that cause the cars 14 to be immobilized or otherwise unsuitable for use while within the hoistway 11. Advantageously, the recovery car 50 can be utilized to remove occupants from these cars 14, service the cars 14, or move the cars 14 to a service location within the elevator system 10. In certain embodiments, the elevator system 10 can include multiple recovery cars 50 disposed at any suitable location.

Figure 2A:
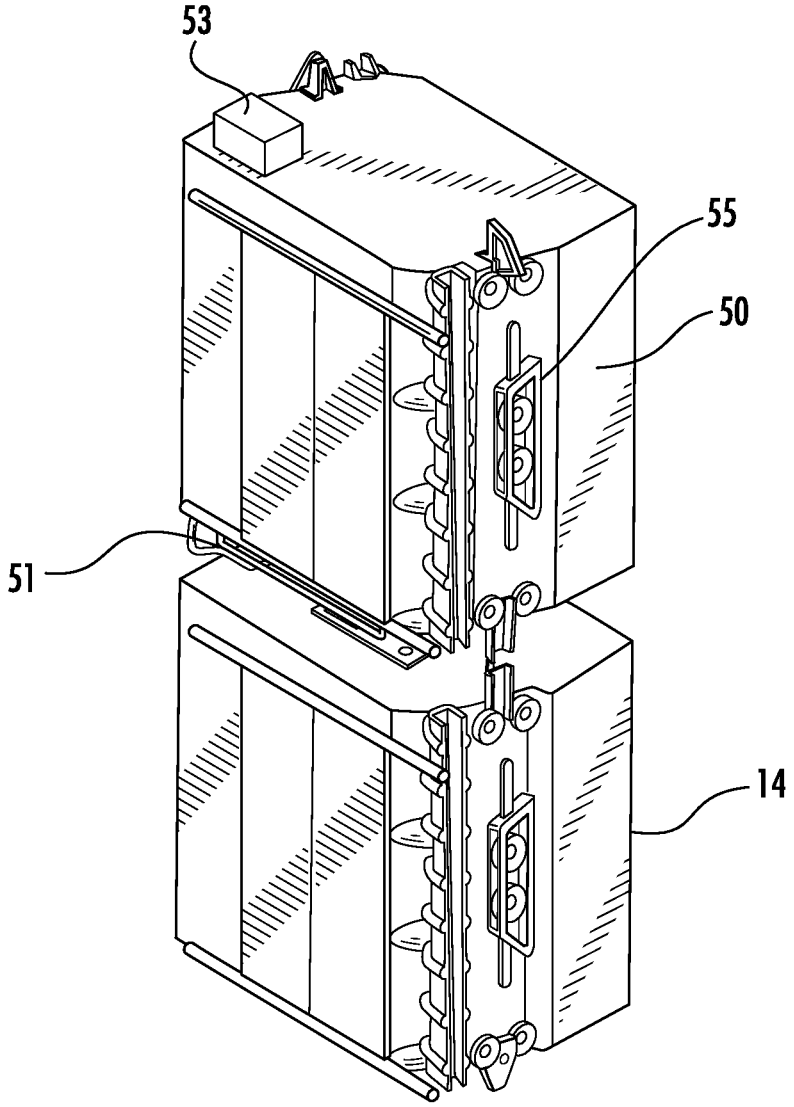
FIG. 2A shows a recovery car for use in a multicar elevator system, such as the system depicted in FIG. 1.
Figure 2B:
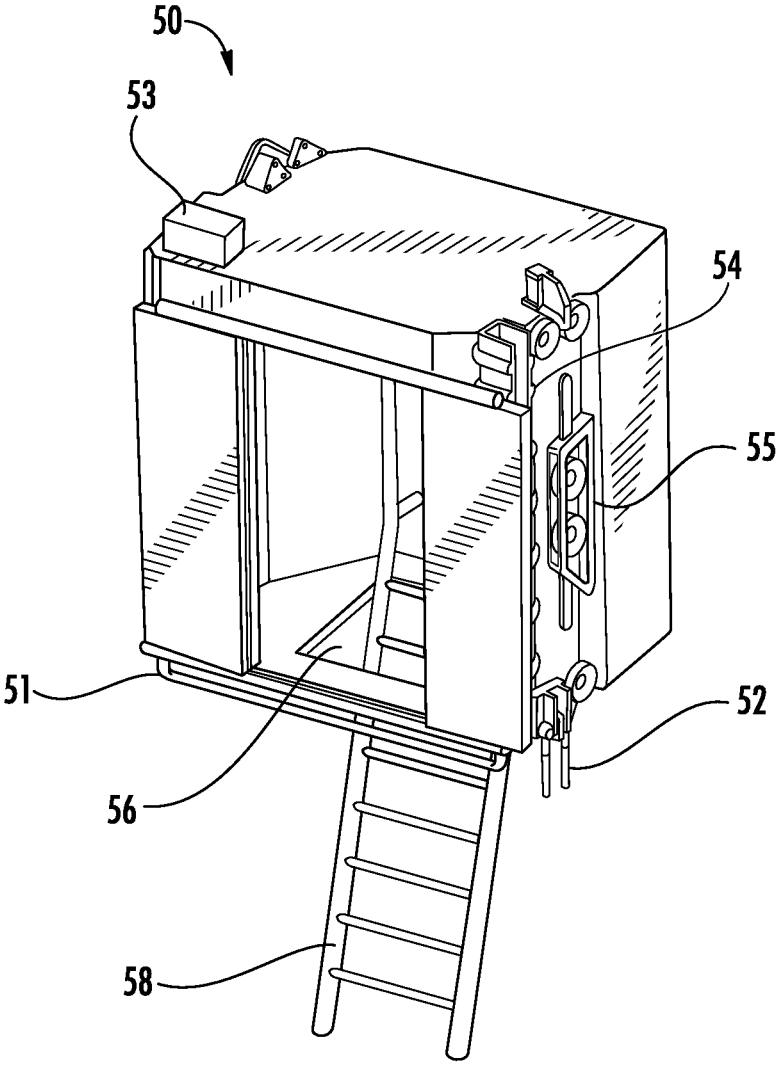
FIG. 2B shows another view of the recovery car.
Figure 2C:
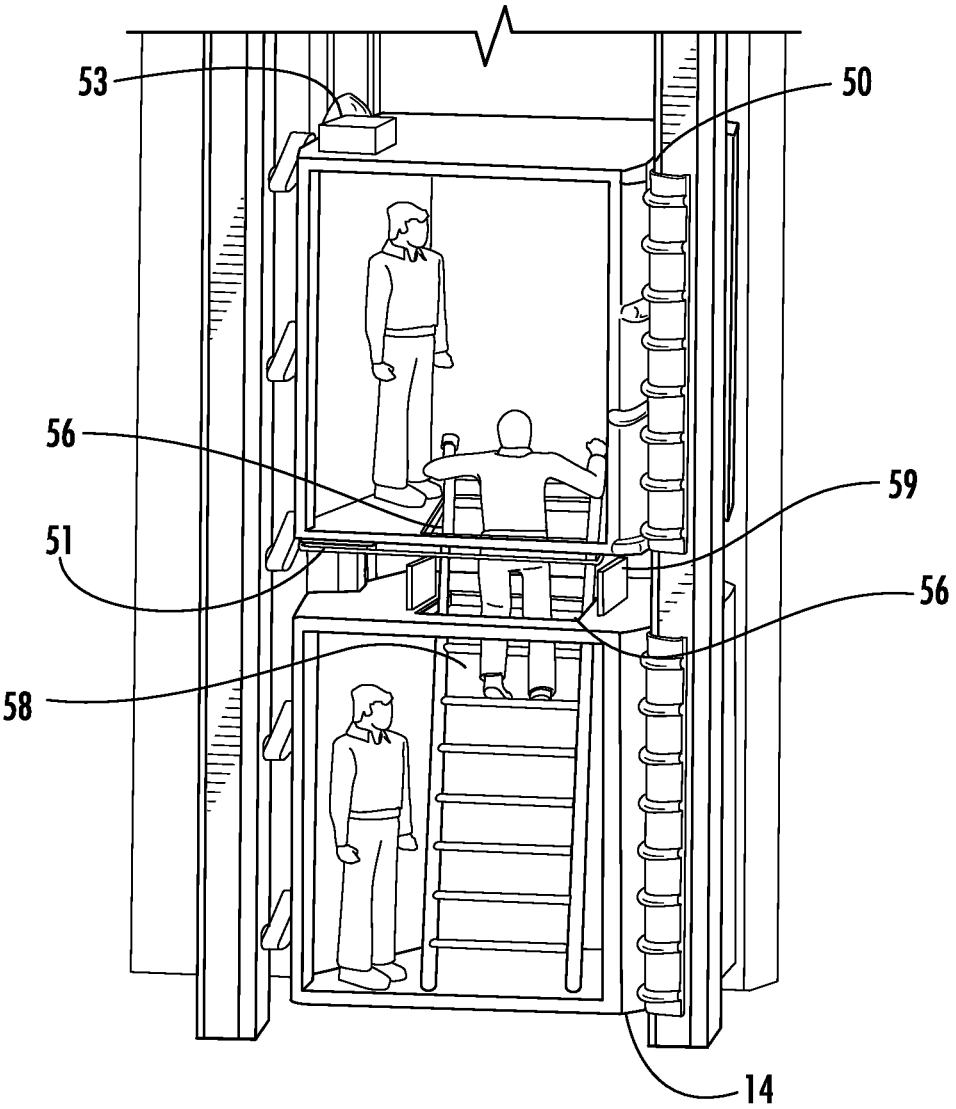
FIG. 2C shows another view of the recovery car.

Referring to FIGS. 2A-2C, a recovery car 50 is shown. In the illustrated embodiment, the recovery car 50 includes an attachment point 52, a motor 54, and a hatch 56. In certain embodiments, the recovery car 50 can allow a technician within the recovery car 50 to control the car 14 or allow remote operation of the car 14. In certain embodiments, any suitable car 14 can be designated or converted to be used as a recovery car 50. Further, in certain embodiments, the recovery car 50 can be utilized with localized directionality functions described herein.

In the illustrated embodiment, the recovery car 50 includes an attachment point 52. In certain embodiments, the cars 14 can include a similar attachment point 52 to allow the recovery car 50 to interface with the car 14. In other embodiments, the attachment point 52 can attach to the car 14 via any suitable feature. In the illustrated embodiment, the attachment point 52 attaches to car 14 via friction. In certain embodiments, the attachment point 52 can utilize clips, or any other suitable attachment method to attach to the car 14. In the illustrated embodiment, the attachment point 52 is suitable to tow the car 14. Advantageously, the use of the attachment point 52 allows for the recovery car 50 to be coupled to the car 14 for repair, occupant recovery, and car 14 recovery operations. The attachment point 52 can be disposed on an upper extent or a lower extent of the recovery car 50.

In order to dispose the recovery car 50 adjacent to the car 14, the recovery car 50 can include a buffer 51 to prevent damage in the event of contact between the recovery car 50 and the car 14. The buffer 51 can be an elastomeric material, an inflatable material, or any other suitable construction to prevent damage in the event of contact. The use of buffer 51 can further reduce the noise of contact between the car 14 and the recovery car 50.

In the illustrated embodiment, the recovery car 50 includes a motor 54 to allow the recovery car 50 to travel within the hoistway 11. The motor 54 can be any suitable motor, such as a linear motor 54 suitable for use within the elevator system 10. In certain embodiments, the motor 54 of the recovery car 50 is a more powerful motor 54 compared to the motor of the car 14 to enable the recovery car 50 to move heavier loads, such as a load required by a recovery car 50 carrying additional components, or to tow, push, or pull a car 14 that is immobilized. In certain embodiments, the motor 54 of the recovery car 50 is designed to move at a slower speed, while allowing for a higher load capability. In certain embodiments, the linear motor 54 can communicate with a longer portion of a motor primary to allow for a higher load capability.

In certain embodiments, the recovery car 50 can include a braking mechanism 55. In the illustrated embodiment, the braking mechanism 55 may be larger than standard braking mechanisms of cars 14 to support the braking demands of carrying additional components, or to tow, push, or pull a car 14 that is immobilized.

In the illustrated embodiment, the recovery car 50 includes a controller 53. In the illustrated embodiment, the controller 53 can control several operations of the recovery car 50 and an attached car 14. During a towing operation, wherein the recovery car 50 is attached to the car 14, the controller 53 can utilize a wired connection or a wireless connection to communicate with the car 14 to release the brakes of the car 14 to initiate a towing procedure. In certain embodiments, the wired connection can be provided via the connection of the attachment point 52 to the car 14. In the illustrated embodiment, the controller 53 can further evaluate the motor 54 performance to determine or test if the motor 54 has sufficient capacity to tow the car 14. In certain embodiments, the controller 53 can analyze characteristics of the connected car 14 to determine a desired safety or motion profile, the car 14 weight, and desired motor 54 performance. In certain embodiments, a car 14 can be towed to another location within the elevator system. In certain embodiments, the car 14 can removed from the active lanes of the elevator system. In other embodiments a car 14 can be replaced by a spare or replacement car while the car 14 is serviced.

Further, in certain embodiments, the controller 53 can receive diagnostic and service information from the car 14. Similarly, this information can be provided via a wired connection or a wireless connection to the car 14. In the illustrated embodiment, the controller 53 in conjunction with a wired or wireless connection to car 14 can provide inter-car communication to occupants within the car 14. In certain embodiments, the controller 53 can override the controls of car 14 to open and close the doors of the car 14 as well as receive signals from on board video cameras to perform remote video inspection. In certain embodiments, the controller 53 can override and control any suitable parameter of the car 14. In certain embodiments, the recovery car 50 can include a self-contained power source to energize the recovery car 50 and/or the car 14.

In the illustrated embodiment, a hatch 56 can allow technician access and occupant egress from the car 14. Advantageously, the hatch 56 allows for access to the car 14 if the doors of the car 14 are not able to open. In the illustrated embodiment, the car 14 includes a similar hatch to allow access out of the car 14. In certain embodiments, the hatch 56 allows for occupants to exit the car 14. In other embodiments, the technician can utilize the hatch 56 to perform inspection, replacement of components, and repairs upon the car 14. In certain embodiments, replacement components are stored within the recovery car 50. In the illustrated embodiment, the hatch 56 allows for access to a car 14 below the recovery car 50. In other embodiments, the hatch 56 allows for access to a car 14 that is disposed above the recovery car 50. The hatch 56 may be latched as necessary during travel.

To facilitate access between the recovery car 50 and the car 14, the recovery car 50 can include a ladder 58. The ladder 58 can allow occupants to exit the car 14 and enter the recovery car 50 and further allow technicians to enter the car 14 from the recovery car 50. In certain embodiments, a shroud 59 can be deployed when the hatch 56 is open. The shroud can prevent the technician or occupants from being exposed to the hoistway 11, and further retains the technicians and occupants therein. The shroud 59 may be permanently affixed to the recovery car 50 or can be deployed as needed.

Figure 3:
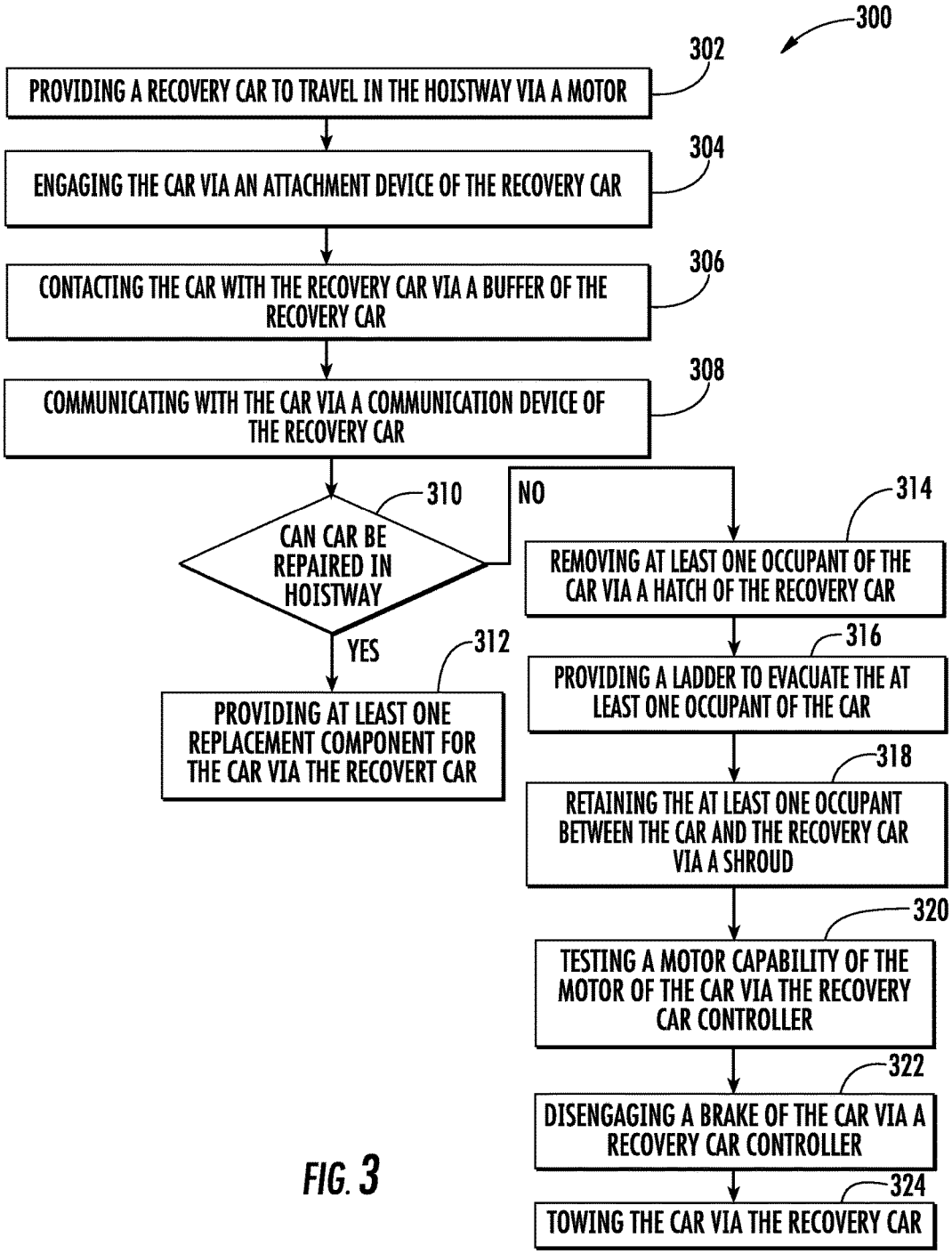
FIG. 3 shows a method for recovering a car within a multicar elevator system.

Referring to FIG. 3 a method to recover occupants and an elevator car within an elevator system is shown. In operation 302, a recovery car is provided to travel in the hoistway via a motor. In certain embodiments, the motor of the recovery car is a more powerful motor compared to the motor of the car to enable the recovery car to move heavier loads, such as a load required by a recovery car carrying additional components, or to tow, push, or pull a car that is immobilized.

In operation 304, the car is engaged to the recovery car via an attachment device of the recovery car. In the illustrated embodiment, the attachment point attaches to car via friction. In certain embodiments, the attachment point can utilize clips, or any other suitable attachment method to attach to car. In the illustrated embodiment, the attachment point is suitable to tow car.

In operation 306, the car contacts with the recovery car via a buffer of the recovery car. The buffer can be an elastomeric material, an inflatable material, or any other suitable construction to prevent damage in the event of contact.

In operation 308, the car can communicate with the recovery car via a communication device of the recovery car. In the illustrated embodiment, the controller in conjunction with a wired or wireless connection to car can provide inter-car communication to occupants within the car.

In operation 310, a technician can determine if the car can be repaired or if it necessary to move the car within the hoistway. If the car can be repaired, operation 312 can be performed. If the car must be moved, operation 314 can be performed.

If a repair is possible, in operation 312, at least one replacement component for the car is provided via the recovery car. In certain scenarios, passengers may either remain within the car or be removed from the car depending on a technician's or other qualified personnel's safety assessment.

If it is desired to move the car, a technician or other qualified personnel may first assess the safety and risk of elevator occupants. In many scenarios, qualified personnel may determine that it is safer to keep occupants within an elevator car during recovery procedures. In other critical situations, qualified personnel may determine that occupants should be removed from the elevator car. In certain embodiments, critical situations can include elevator cars that cannot be towed or other dangerous situations.

In operation 314, at least one occupant of the car is removed via a hatch of the recovery car. In operation 316, a ladder is provided to the at least one occupant of the car. The ladder can allow occupants to exit the car and enter the recovery car.

In operation 318, at least one occupant is retained between the car and the recovery car via a shroud. The shroud can prevent the technician or occupants from being exposed to the hoistway, and further retains the technicians and occupants therein.

If it is desired to move the car, in operation 320, the motor capability of the motor of the car is tested via the recovery car controller. In the illustrated embodiment, the controller can evaluate the motor performance to determine or test if the motor has sufficient capacity to tow the car.

In operation 322, a brake of the car is disengaged via a recovery car controller. During a towing operation, wherein the recovery car is attached to the car, the controller can utilize a wired connection or a wireless connection to communicate with the car to release the brakes of the car to initiate a towing procedure.

In operation 324, the car is towed via the recovery car. The car can be towed to any suitable location, such as a predetermined service location within the elevator system.

The terminology used herein is for the purpose of describing particular embodiments only and is not intended to be limiting of the embodiments. While the description of the present embodiments has been presented for purposes of illustration and description, it is not intended to be exhaustive or limited to the embodiments in the form disclosed. Many modifications, variations, alterations, substitutions or equivalent arrangement not hereto described will be apparent to those of ordinary skill in the art without departing from the scope and spirit of the embodiments. Additionally, while various embodiments have been described, it is to be understood that aspects may include only some of the described embodiments. Accordingly, the embodiments are not to be seen as limited by the foregoing description, but are only limited by the scope of the appended claims.

What is claimed is:

1. A method to recover a car in a hoistway of an elevator system comprising:

providing a recovery car to travel in the hoistway, the recovery car including: an attachment device, a recovery car controller integrated into and movable with the recovery car, and a motor operable to move the recovery car within the hoistway, wherein the motor of the recovery car is more powerful than a motor of the car, engaging the car via the attachment device of the recovery car;

receiving service and diagnostic information from the car at the recovery car controller when the recovery car and the car are attached via the attachment device; and determining whether to repair the car or to tow the car in response to the service and diagnostic information.

2. The method of claim 1, further comprising contacting the car with the recovery car via a buffer of the recovery car.

3. The method of claim 1, further comprising communicating with the car via a communication device of the recovery car.

4. The method of claim 1, further comprising removing at least one occupant of the car via a hatch of the recovery car.

5. The method of claim 1, further comprising providing a ladder to at least one occupant of the car.

6. The method of claim 1, further comprising restricting access of at least one occupant to the hoistway by deploying a shroud between the car and the recovery car.

7. The method of claim 1, further comprising:

identifying at least one component of the car to be repaired in the hoistway; and providing at least one replacement component for the car via the recovery car in response to identifying the at least one component to be repaired.

8. The method of claim 1, further comprising towing the car via the recovery car.

9. The method of claim 1, further comprising disengaging a brake of the car via the recovery car controller.

10. The method of claim 1, further comprising testing a motor capability of the motor of the car via the recovery car controller.

11. A recovery car to recover a car in a hoistway of an elevator system, the recovery car comprising:

a motor to transport the recovery car within the hoistway, wherein the motor of the recovery car is more powerful than a motor of the car;

an attachment device to engage the car in the hoistway;

a recovery car controller integrated into and movable with the recovery car, the recovery car controller receiving service and diagnostic information from the car when the recovery car and car are attached.

12. The recovery car of claim 11, further comprising a buffer to contact the car.

13. The recovery car of claim 11, further comprising a communication device to communicate with the car.

14. The recovery car of claim 11, further comprising a hatch operable to provide an opening through which an occupant may egress from the car.

15. The recovery car of claim 11, further comprising a ladder to provide access to the car.

16. The recovery car of claim 11, further comprising a shroud extending between the recovery car and the car to restrict access to the hoistway.

17. The recovery car of claim 11, wherein the recovery car tows the car via the attachment device.

18. The recovery car of claim 11, wherein the recovery car is disposed above or below the car.

19. The recovery car of claim 11, wherein the recovery car controller is operable to disengage a brake of the car.

* * * * *